US005233704A

United States Patent [19]

Booher

[11] Patent Number: 5,233,704

[45] Date of Patent: Aug. 10, 1993

[54] SCARF OR OTHER BAND-LIKE APPAREL MEMBER

[76] Inventor: Ruth E. Booher, 3208 Inverness Cliffs, Birmingham, Ala. 35242

[21] Appl. No.: 765,977

[22] Filed: Sep. 26, 1991

[51] Int. Cl.[5] ..... A42B 1/00

[52] U.S. Cl. ..... 2/207; 140/104

[58] Field of Search ..... 2/198, 207, 209.1, DIG. 11; 140/104

[56] References Cited

U.S. PATENT DOCUMENTS

| | | | |
|---|---|---|---|
| 1,692,719 | 11/1928 | Busey | 2/198 |
| 2,006,355 | 7/1935 | Howell | 140/104 |
| 2,767,404 | 10/1956 | Collins | 2/207 |
| 3,471,867 | 10/1969 | Kirchhoff | 2/207 |
| 3,668,707 | 6/1972 | Williams | 2/207 |
| 5,081,717 | 1/1992 | Shedd | 2/209.1 |

FOREIGN PATENT DOCUMENTS

| | | | |
|---|---|---|---|
| 528567 | 2/1955 | Italy | 140/104 |

OTHER PUBLICATIONS

McCall's Crafts No. 882/3461, 1987.

*Primary Examiner*—Clifford D. Crowder
*Assistant Examiner*—Diana L. Biefeld
*Attorney, Agent, or Firm*—Robert C. Sullivan

[57] ABSTRACT

A scarf or other band-like apparel member which includes a pliable metal wire positioned interiorly of the scarf or the like, together with means to facilitate grasping the metal wire to aid in forming the scarf or other apparel member to the desired configuration or adjustment. When used us a scarf, the band-like apparel member of the invention is adapted to be easily adjusted to the proper neck size of the wearer since the pliable metal wire which forms part of the scarf can be twisted to adjust the size of the scarf to the proper neck size, thereby eliminating the need for additional accessories or the like such as scarf clips, pins or knots. A particular feature of the band-like apparel member of the invention is that once it has been adjusted to a desired optimum position, location, or angle it remains in that adjusted position until purposely changed.

16 Claims, 3 Drawing Sheets

FIG. 1
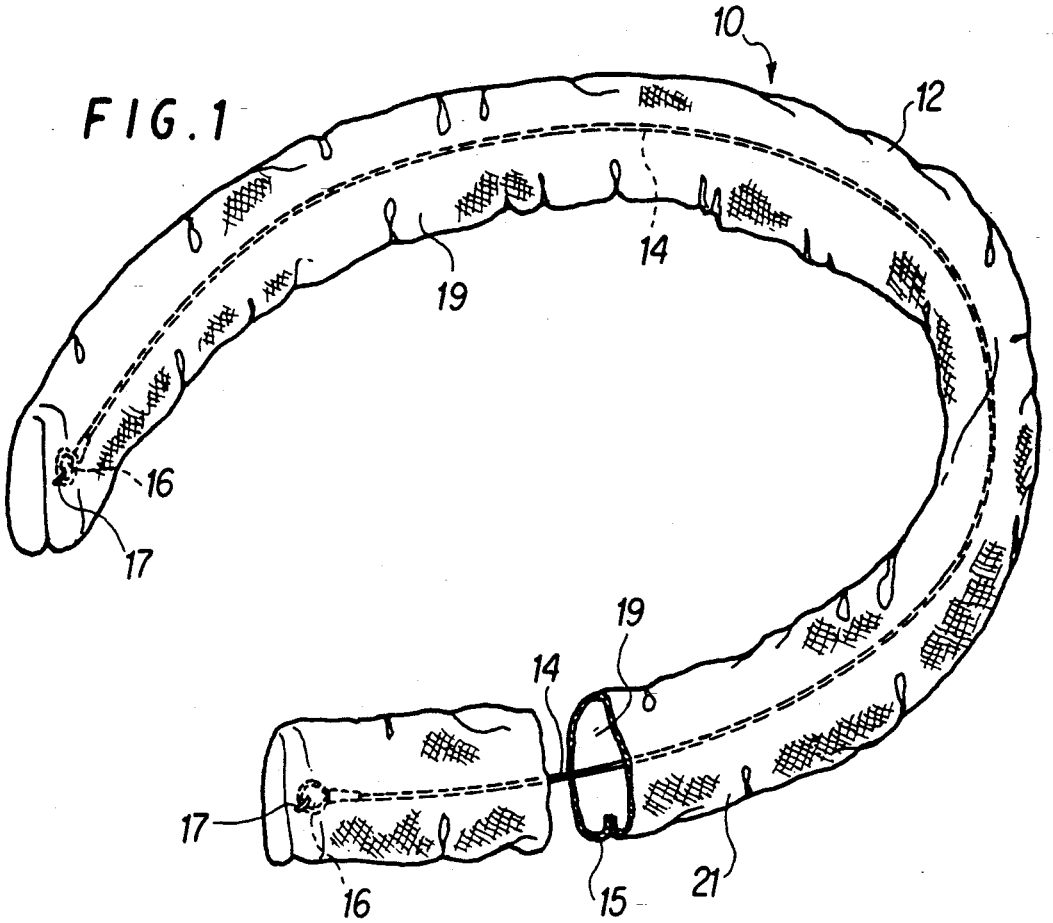
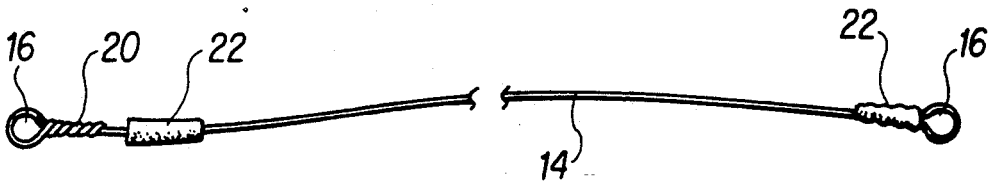
FIG. 2
FIG. 3
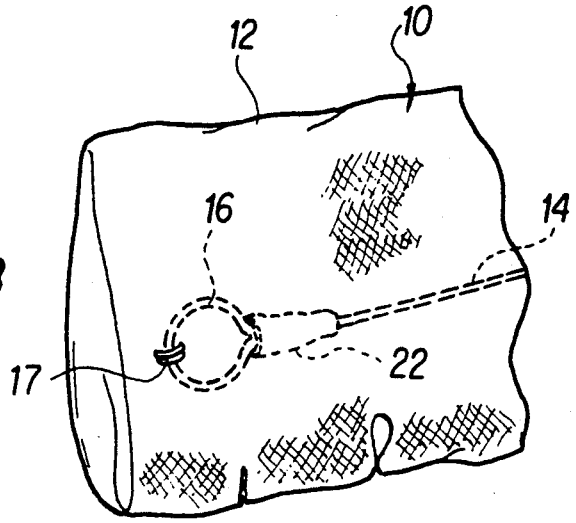

SCARF OR OTHER BAND-LIKE APPAREL MEMBER

BACKGROUND OF THE INVENTION

1. Field of the Invention

The present invention relates to scarf-like or band-like apparel members such as scarves, waistbands, neckbands, headbands, hairbands and hatbands. A Disclosure Document entitled "FASHION TWIST" relating to the present invention was filed by applicant in the United States Patent and Trademark Office in 1991.

2. Description of the Prior Art

In using prior art ladies' scarfs, ladies have spent many hours and much money in scarf-tieing classes, and for video instruction and instruction booklets. Despite such efforts many ladies become discouraged with the time-consuming process of creating an acceptable design with the hope that the scarf design or arrangement will remain fixed or stationary during the day. Despite the efforts of these ladies, slipping and sliding occurs within a short time of placing the scarf on. Furthermore, the use of knots, pins or scarf clips to maintain the scarf at a desired neck size adjustment does not prove satisfactory. Knots stretch the scarf fabric. Pins puncture little holes in the scarf fabric. Scarf clips winkle the scarf.

In discussing the background of the present invention and in describing and in showing in the drawings the construction of the various embodiments of the present invention, reference to scarves will often be made. However, in many instances such descriptive material and drawings will also be equally applicable to other types of band-like apparel members such as waistbands, neckbands, headbands, hairbands and hatbands.

2. Prior Art

A search was made at the United States Patent and Trademark Office and the following references were noted:

U.S. Pat. No. 548,738—Ballard (1895) shows an ear and neck muff which has a wire frame covered by cloth or felt material.

U.S. Pat. No. 932,487—Melio (1909) shows a combined ear muff and neck protector, including a frame formed of an endless piece of resilient wire. A shield secured to the frame is formed of fabric, felt or the like.

U.S. Pat. No. 1,287,626—Brett (1918) shows a bandeau having a pliable metallic core such as soft copper or iron wire and a pliable non-metallic covering.

U.S. Pat. No. 2,560,095—Dolphin (1951) shows a twisted bow hair ribbon including a deformable metal wire which is positioned within an overlap 3 of the hair ribbon. When the hair ribbon is twisted about the hair, the length of deformable metal wire within the hair ribbon maintains the hair ribbon in its twisted position.

U.S. Pat. No. 3,471,867—Kirchoff (1969) relates to a "scarf with a coil-type rib", including a flexible retaining band which automatically wraps around the head or neck of the user. The flexible retaining band is formed of a flexible plastic rib which assumes a coil configuration in its natural state.

Belgian patent document 521292 (1953) shows a scarf or sash which is reinforced contiguous its perimeter by a wire-like member of nylon (see FIG. 3).

German patent document 805809 (1951) shows a head covering in which metal strips serve as stiffeners in the head covering.

OBJECTS OF THE INVENTION

Accordingly, it is an object of the present invention to provide a construction for a band-like apparel member such as ladies' scarves or the like in which the scarf can be moved to a fixed adjusted position about the lady's neck, in which position it will remain until purposely moved away from that adjusted position.

It is another object of the present invention to provide a scarf which can be easily adjusted to the proper neck size of the wearer.

It is another object of the present invention to provide a band-like apparel member such as a scarf for lady's wear in which there is no need for pins, clips, knots, or other securing gadgets to maintain the scarf in a predetermined desired position or neck size adjustment.

It is another object of the invention to provide a band-like apparel member such as a scarf which may be worn by women of all ages and which is designed to add beauty, comfort and flexibility to accent and decorate ladies' wear.

It is another object of the invention to provide a band-like apparel member such as a scarf which adds color and flair to casual, business, formal, or any other costume a woman wears.

It is another object of the invention to provide a scarf construction in which the scarf is in effect pre-folded to, for example, a three-inch width for placement around the wearer's neck, thereby avoiding the necessity of manually folding the scarf to a three-inch width before placing the scarf around the wearer's neck.

In achievement of these objectives, there is provided in accordance with this invention a scarf or other band-like apparel member which includes a pliable metal wire positioned interiorly of the scarf or the like, together with means to facilitate grasping the metal wire to aid in forming the scarf or other apparel member to the desired configuration or adjustment.

When used as a scarf, the band-like apparel member of the invention is adapted to be easily adjusted to the proper neck size of the wearer since the pliable metal wire which forms part of the scarf can be twisted to adjust the size of the scarf to the proper neck size, thereby eliminating the need for additional accessories or the like such as scarf clips, pins or knots.

A particular feature of the band-like apparel member of the invention is that once it has been adjusted to a desired optimum position, location, or angle it remains in that adjusted position until purposely changed.

Further objects and advantages of the invention will become apparent from the following description taken in conjunction with the accompanying drawings in which:

BRIEF DESCRIPTION OF THE DRAWINGS

FIG. 1 is a top plan view of a band-like apparel member such as a scarf in accordance with one embodiment of the invention;

FIG. 2 is a view of the wire member which extends along a substantial portion but not the entire length of the interior of the sleeve portion of the band-like apparel member of FIG. 1;

FIG. 3 is a fragmentary, broken-away view of one portion of the length of the band-like apparel member of FIG. 1, showing the outer sleeve of the band-like apparel member and also showing a view in phantom of the wire inside the sleeve, with the loop on the end of the wire being attached by stitching to fabric at the adjacent end of the sleeve;

Figure 4:
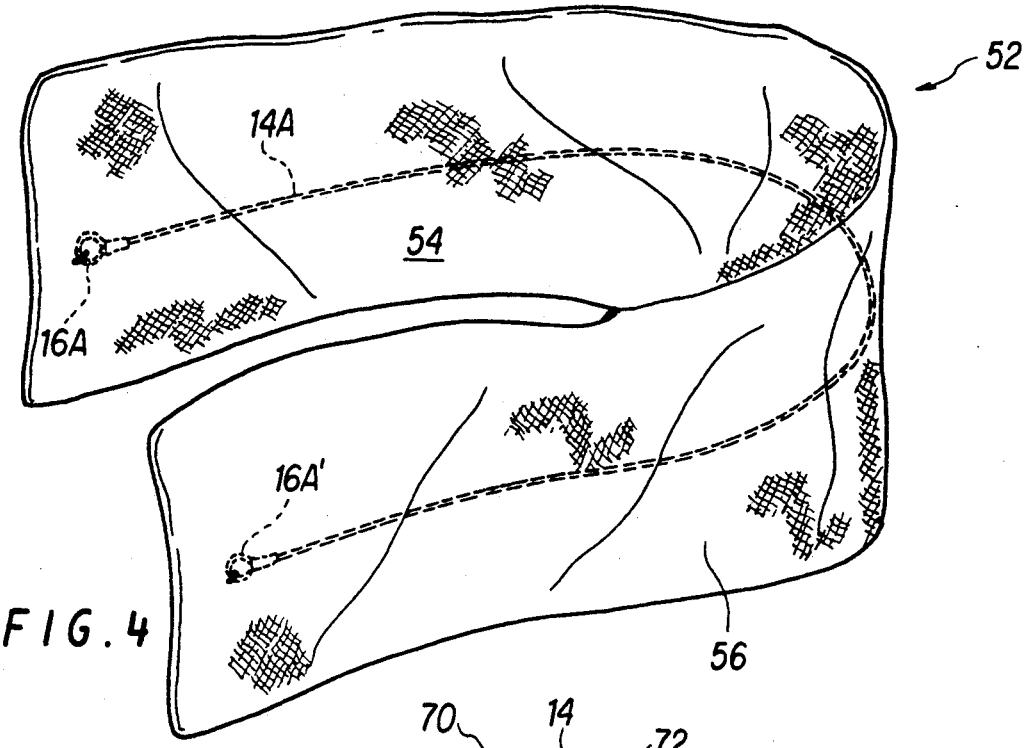
FIG. 4 is a view of a modified band-like apparel member such as a scarf in accordance with the invention.

Referring now to the drawings, and more particularly to FIGS. 1-3, inclusive, there is shown a scarf generally indicated at 10 including a hollow sleeve-like member generally indicated at 12 formed of a suitable fabric, and a pliable and deformable wire member 14 positioned interiorly of the hollow sleeve 12.

The sleeve-like member 12 may be made of a suitable fabric such as polyester, silk, or cotton or of a suitable blend of different fibers such as silk and wool blended together while in fiber form. The fabric of which sleeve 12 is formed may have, for example, a floral design, or a geometric print design thereon, or, alternatively, may be of a solid color such as red, green, etc.

In the embodiment illustrated in FIGS. 1 and 3, the hollow sleeve-like member 12 is closed at both ends.

In a typical construction of the embodiment of the scarf such as that shown in FIGS. 1-3, the lengthwise dimension of the fabric portion of sleeve 12 may be, for example, 45 inches and the transverse dimension of the fabric portion of sleeve 12 after being folded in half in a lateral direction, as will be explained in more detail, hereinafter, may be 3 inches (6 inches before folding).

The wire 14 which may be, for example, of 0.038 inch diameter low carbon galvanized steel is approximately 33 inches long (including the loops 16 to be described) when used in combination with a fabric sleeve such as the sleeve 12 of FIGS. 1 and 3. The sleeve 12 in the embodiment in this case would be approximately 45 inches long. Thus, the sleeve 12 in the illustrated embodiment would be approximately 12 inches longer than the wire 14.

The wire 14 is provided at each of its opposite ends with a loop 16, each loop 16 having a diameter of 5/16 inch. After the loops 16 have been formed at the opposite ends of wire 14 the remaining end of the wire 14 beyond the loop is twisted around the long base of wire 14 as indicated at 20. The twist portion 20 at each end of wire 14 is approximately one to one and one-half inches long. To reinforce the twist portion 20 at each end, a 3/32 inch shrink tubing 22, clear in color, envelopes the twists at each end. The shrink tubing 22 protects against any damage to the fabric of sleeve 12, and also prevents injury to the person handling the scarf due to contact with twist portion 20. Shrink sleeves are well known per se.

The loop 16 at each end of wire 14 is threadedly tacked as indicated at 17 in FIGS. 1 and 3 by sewing to the contiguous end of fabric sleeve 12, the respective loops 16 at opposite ends of wire 14 being threadedly tacked to the corresponding opposite ends of fabric sleeve 12. Since in the example being described in connection with FIGS. 1-3, fabric sleeve 12 is approximately 12 inches longer than wire 14 including loops 16 at opposite ends of wire 14 to which the ends of fabric sleeve 12 are secured, it follows that there is provided a fluffy and full fabric appearance of fabric sleeve 12.

The loops 16 at the opposite ends of metal wire 14 are an important aspect of the present invention as will be seen by the following enumeration of the functions and advantages of the loops 16:

(1) By providing a loop 16 at each of the opposite ends of the metal wire 14 rather than having the wire at each end thereof terminate in a point, the danger of the user pricking his or her finger is prevented.

(2) By providing a loop 16 at each of the opposite ends of the metal wire 14 rather than having the wire at each end thereof terminate in a point, the danger of the fabric sleeve being torn by a sharp end point on the wire is eliminated.

(3) The loops 16 at the opposite ends of metal wire 14 provide convenient means to anchor the ends of the metal wire to the fabric sleeve by a stitched connection between the loop at each end of the metal wire and the contiguous surfaces of the fabric sleeve.

(4) The loops 16 at the ends of the metal wire provide convenient "handles" which the user can grasp as an aid in manipulating or adjusting the band-like apparel member such as a scarf or the like to provide a desired adjustment.

In manufacturing the scarf 10 shown in FIGS. 1-3, inclusive, the fabric of which sleeve 12 is to be formed is cut into six-inch widths and forty-five inch lengths. The fabric is then folded in half, so that the six-inch width becomes three inches wide. One half inch seam allowances are allowed on the three raw edges—i.e.—the top and bottom three inch edges and the long forty-five inch edge. An opening of approximately one inch in length is left on the long forty-five inch raw edge to allow for turning the fabric right side u and for inserting the wire 14 into the interior of sleeve 12. The three edges, except for the one inch opening, are then stitched to form a tube which is closed except for the aforementioned one inch opening. To invert the surfaces of the tubular sleeve, (i.e.—to turn the sleeve "inside out") the material of the sleeve is pulled out through the aforementioned one inch opening, so that what had originally been the rough or raw outside surface of the seam is turned inwardly as seen at 15 in FIG. 1. This procedure per se is well known and old in the textile industry.

After the sleeve 12 has been turned "inside out" as just described, the wire 14 is inserted into the interior of the sleeve 12 through the on inch opening. The loops 16 at the opposite ends of wire 14 are stitched to the corresponding opposite ends of the sleeve using clear plastic thread and a buttonhole stitch. The one inch opening is closed by using fabric glue which is well known, or by other suitable means. The loop 16 at each end of wire 14 is attached by stitching to both the inwardly facing fabric portion 19 (FIG. 1) of sleeve 12 and to the outwardly facing fabric portion 21 (FIG. 1) of sleeve 12.

While the member generally indicated at 10 in FIGS. 1-3 has been described as a scarf, the member 10 could also be a waistband, a neckband, a headband, a hairband or a hatband.

The scarf of FIGS. 1-3 may be worn as one would wear any scarf. The scarf of FIGS. 1-3 has all the benefits and versatility of traditional scarves because it can be worn as a decorative accent around the neck and head. Additionally, it can be worn around the waist, or used to decorate a hat.

The scarf 50 shown in FIG. 4 includes a hollow sleeve member 52 formed of a suitable fabric such as that described in connection with the embodiment of FIGS. 1-3, inclusive. Sleeve member 52 comprises an inwardly facing fabric piece 54 and an outwardly facing fabric piece 56. A metal wire 14A which may be similar to the metal wire 14 of FIGS. 1-3 is positioned interiorly of sleeve member 52 between the inwardly facing fabric piece 54 and the outwardly facing fabric piece 56. Metal wire 14A is bent at the opposite ends thereof to have oppositely disposed loops 16A and 16A' similar to the loops 16 on the wire 14 of the previously described embodiment of FIGS. 1-3.

The two loops 16A, 16A' of metal wire 14 are attached by sewing only to the inside piece of fabric 54 in FIG. 4 leaving the outer piece 56 of fabric free. This is in contrast to the embodiment of FIGS. 1-3 in which each wire loop 16 is attached by stitching to both the inwardly facing fabric portion 19 (FIG. 1) of sleeve 12 and to the outwardly facing fabric portion 21 (FIG. 1) of sleeve 12. This (FIG. 4) provides a shorter scarf effect which can be worn primarily around the neck, but may also be a decorative hair, hat, or waist accent: The free-flowing outer piece of fabric 56 provides fullness; while the wire provides ability to secure, shape and form the scarf in any manner the wearer chooses. The two loops 16A and 16A' on metal wire 14 serve as an attaching device for the metal wire, and protect the fabric and the body of the wearer.

Also the loops 16A and 16A' help in shaping and forming the desired design of the scarf or the like by providing a handle which may be grasped by the wearer of the scarf or the like.

Figure 5:
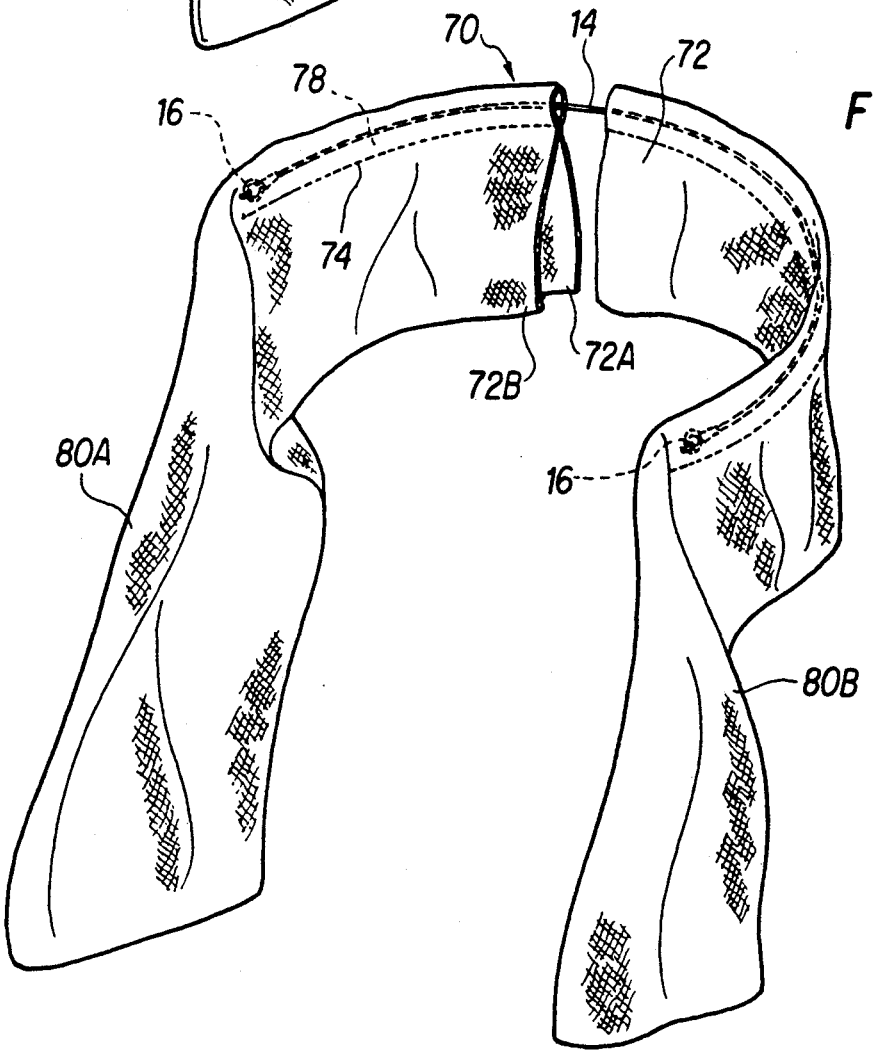
FIG. 5 is still another modified version of a band-like apparel member such as a scarf having a free flowing characteristic.

There is shown in FIG. 5 another modified embodiment of the invention comprising a scarf generally indicated at 70 which has all the benefits and advantages of a large rectangular scarf.

As in the embodiments of FIGS. 1-3 and 4, the scarf 70 comprises a fabric member generally indicated at 72 which may be made of any of the fabric materials described in connection with the embodiments of FIGS. 1-3 and 4.

The scarf 72 is folded in half to define an outer layer 72A and an inner layer 72B. The central portion of the length of the scarf which lies along the neck area of the person wearing the scarf has a U-shaped curve formed when the scarf is placed around the neck area of the wearer. The inner and outer layers 72A, 72B of the scarf are stitched as indicated at 74 in FIG. 5 to define a pocket 78. Positioned in pocket 78 is a metal wire 14 having loops 16 at its opposite ends, the wire 14 also including the twisted portions 20 and the heat shrink tubing 22 all as described in connection with the embodiments of FIGS. 1-3.

The metal wire 14 in FIG. 5 functions in the same manner as previously described in connection with the embodiments of FIGS. 1-3. Each of the loops 16 of wire 14 are stitched or otherwise anchored to fabric member 72. The loops 16 used in the embodiment of FIG. 5 have the same functions and advantages as previously discussed in detail in connection with the embodiment of FIGS. 1-3.

The scarf 70 of FIG. 5 is a full free-flowing scarf, primarily to be worn around the neck area. On either side of the neck portion of the scarf defined by the metal wire 14 and the pocket 78 which receives the metal wire, the free-flowing opposite end portions 80A, 80B of the scarf can be allowed to drape over front and back shoulders or freely in any desired location. The free-flowing aspect of both ends 80A, 80B provides bow-tieing around the desired area, arrangements with loose ends which can be tucked under the wire around the neck to create desired looks and designs.

Figure 6:
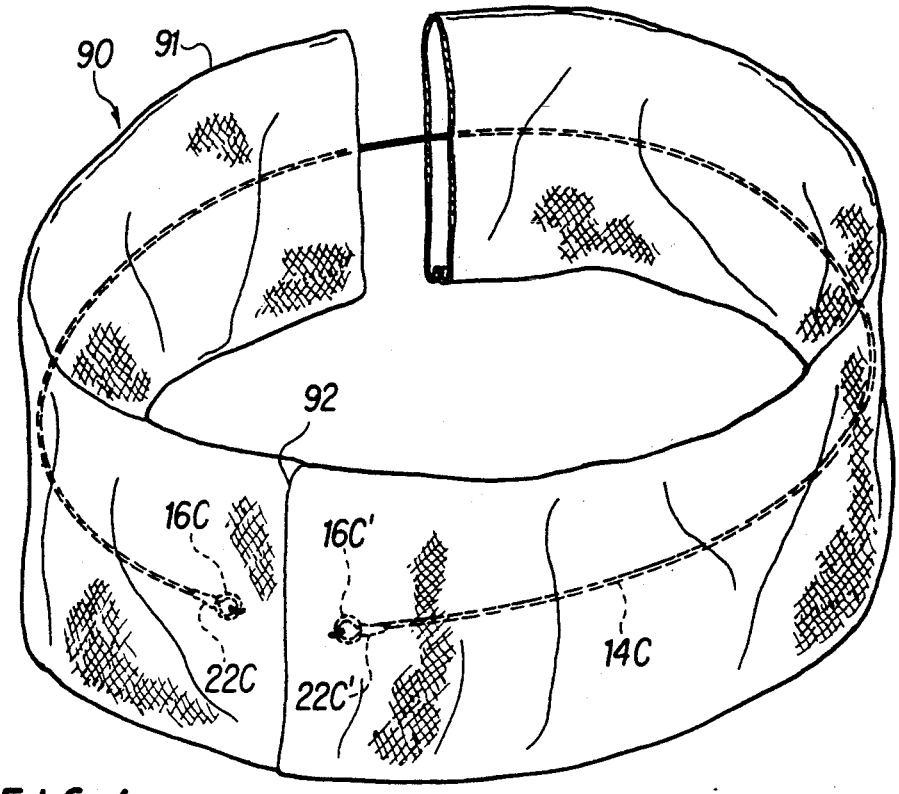
FIG. 6 is still another modified version of a band-like apparel member comprising a scarf formed of generally cylindrical shape which is adapted to be slipped down over the wearer's head onto the wearer's neck.

There is shown in FIG. 6 a still further modified embodiment in which the scarf generally indicated at 90 is formed of a band-like sleeve member 91 which is closed upon itself into a generally cylindrical shape. The sleeve member 91 may be made of any suitable fabric such as those previously described in connection with FIGS. 1-5.

The band-like sleeve 91 in the embodiment shown in FIG. 6 is formed of a fabric which is folded in half as described in detail in connection with the embodiment of FIGS. 1-3 inclusive.

In the embodiment of FIG. 6, however, the two free ends of the sleeve 91 are joined together by a seam 92 to form a member of generally cylindrical shape.

Prior to joining the two free ends of sleeve member 91 at the seam 92 as seen in FIG. 6, a metal wire 14C similar to the metal wire 14 previously described in connection with the embodiment of FIGS. 1-3 is introduced into the interior of sleeve 91 of FIG. 6 in the manner described in connection with the embodiment of FIGS. 1-3. The wire 14C of FIG. 6 is provided with loops 16C and 16C' which are attached by stitching to the one vertical seam 92 which joins the two ends of sleeve 91.

The respective loops 16C and 16C' at the opposite ends of metal wire 14C are tacked (sewed) to the fabric seam 92 using clear plastic thread and a buttonhole stitch.

The wire 14C in FIG. 6 is provided with shrink tubing 22C and 22C' to cover the twisted wire near each loop 16C and 16C' as previously described in connection with the embodiment of FIGS. 1-3.

The loops 16C and 16C' at opposite ends of wire 14C are located a relatively short distance from and on opposite sides of the seam 92 which joins two contiguous opposite ends of sleeve 91 together.

Other than its threaded connection to fabric sleeve 9 wire 14C is free floating inside fabric sleeve 91.

In use, the scarf 90 is slipped over the wearer's head, being allowed to drape freely around the neck of the wearer. The pliability of the metal wire 14C permits the scarf to be shaped for a closer neck fit and for a desired shape and design. As in the other embodiments of FIGS. 1-5 hereinbefore described, the wire loops 16C and 16C' aid in grasping the metal wire 14C and the fabric sleeve 91 to shape and form a desired design with scarf 90.

The scarf 90 of the embodiment of FIG. 6 is primarily for neckware, but can also be used as a hairband.

Figure 7:
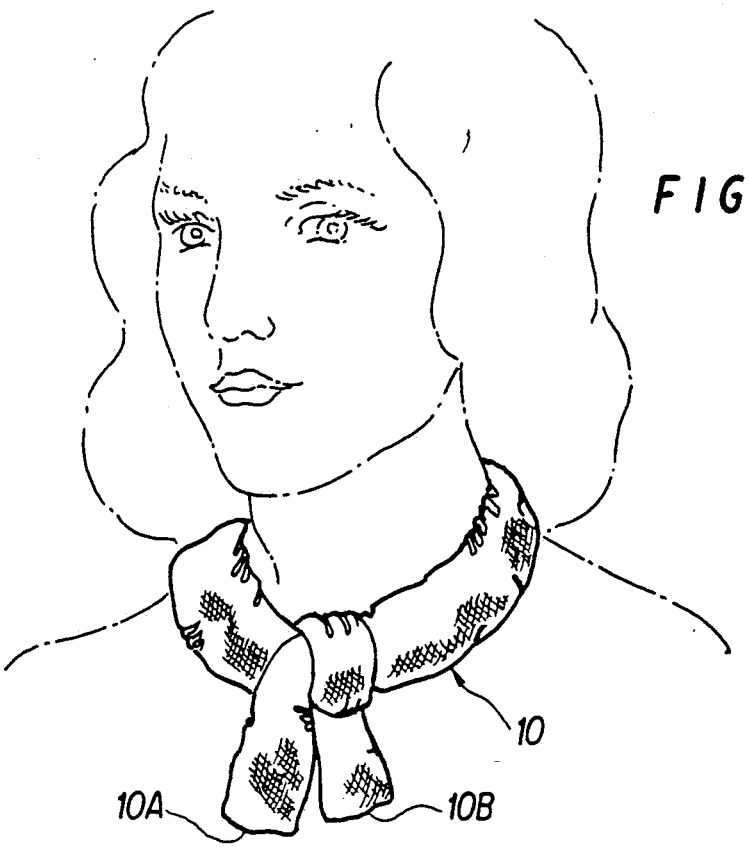
FIG. 7 shows the scarf of FIGS. 1-3, inclusive, positioned around the neck of the wearer, with the ends of the scarf twisted together.

Referring now to FIG. 7, the scarf 10 of FIGS. 1-3 is shown positioned about the neck of a lady wearing the scarf. The two free ends 10A, 10B of the scarf have been twisted together to secure the scarf in place about the wearer's neck and to conform the scarf to the neck size or neck diameter of the wearer. After the scarf has been secured about the wearer's neck by twisting the ends 10A, 10B as just described, the scarf may then be shaped and formed to the desired design and side on which the user wishes to wear the scarf by gently moving the fabric of the scarf, preferabley by grasping the loops 16 which permit adjustment of the scarf and of the sleeve portion 12 thereof.

After the scarf has been placed about the wearer's neck by twisting the ends 10A, 10B (FIG. 7) of the scarf, if it is later desired to remove the scarf, this can be done by untwisting the two ends 10A, 10B.

From the foregoing detailed description of the invention, it has been shown how the objects of the invention have been obtained in a preferred manner. However, modifications and equivalents of the disclosed concepts such as readily occur to those skilled in the art ar intended to be included within the scope of this invention.

The embodiments of the invention in which an exclusive property or privilege is claimed are defined as follows:

1. A scarf or other band-like apparel member comprising a fabric sleeve, a pliable metal wire extending within said sleeve lengthwise of said sleeve, and means carried by said metal wire adapted to have force exerted thereon from outside said sleeve as an aid in shaping and forming said apparel member in a desired manner, said means carried by said metal wire comprising a substantially closed loop formed from said wire contiguous but spaced from the end of said wire, said wire being double back upon itself beyond said loop and being twisted about another portion of said wire contiguous said loop to define a twisted region.

2. A scarf or other bank-like apparel member as defined in claim 1, in which said metal wire comprises a separate loop formed at each end of said metal wire.

3. A scarf or other band-like apparel member as defined in claim 2 comprising means connecting each of said separate loops to said sleeve at a point adjacent a corresponding one of the opposite ends of said sleeve.

4. A scarf or other band-like apparel member as defined in claim 3 in which said means connecting said separate loops to said sleeve is thread.

5. A scarf or other band-like apparel member as defined in claim 1 in which said sleeve is substantially longer than said wire.

6. A scarf or other band-like apparel member as defined in claim 5 in which the length relation of said sleeve to said wire and the manner of interconnection of said sleeve to said wire causes a full and fluffy effect on said sleeve.

7. A scarf or other band-like apparel member as defined in claim 1 in which said sleeve is a tubular-like member which comprises an inwardly facing fabric portion in contact with the wearer and an outwardly facing fabric portion normally not in contact with the wearer, said wire being interposed between said inwardly facing and said outwardly facing fabric portions.

8. A scarf or other band-like apparel member as defined in claim 7 in which each of said loops is connected to both said inwardly facing and said outwardly facing fabric portions.

9. A scarf or other band-like apparel member as defined in claim 7 in which each of the said loops is connected only to said inwardly facing fabric portion, whereby said outwardly facing fabric portion is free.

10. A scarf or other band-like apparel member as defined in claim 1 in which said sleeve is of substantially cylindrical shape, being closed upon itself.

11. A scarf or other band-like apparel member as defined in claim 1 in which a tubular sleeve-like member is in enveloping relation to said wire in said twisted region.

12. A scarf or other band-like apparel member as defined in claim 11 in which said tubular sleeve-like member is a shrink-fit tubing.

13. A scarf or other band-like apparel comprising a fabric member folded along the length thereof to define an inner layer and an outer layer, said fabric member including a central portion normally lying along the neck region of the wearer, said fabric member including a free flowing fabric portion extending on either side of said central portion, said inner and outer layers in said central portion being provided with a pocket extending along the length of said central portion, a pliable metal wire, said metal wire being received in said pocket, a corresponding substantially closed loop carried by each of the respective opposite ends of said metal wire, said wire being doubled back upon itself beyond each loop and being twisted about another portion of said wire contiguous each loop to define a twisted region contiguous each loop.

14. A scarf or other band-like apparel member as defined in claim 13 in which a corresponding tubular sleeve-like member is in enveloping relation to said wire in each of said twisted regions.

15. A scarf or other band-like apparel member as defined in claim 14 in which each of said tubular sleeve-like members is a shrink-fit tubing.

16. A scarf or other band-like apparel member comprising a fabric member folded along the length thereof to define an inner layer and an outer layer, said fabric member including a central portion normally lying along the neck region of the wearer, said inner and outer layers in said central portion being provided with a pocket extending along the length of said central portion, and at an edge thereof, a pliable metal wire, said metal wire being received in said pocket, a substantially closed corresponding loop carried by each of the respective opposite ends of said metal wire, said wire being doubled back upon itself beyond each loop and being twisted about another portion of said wire contiguous each loop to define a twisted region contiguous each loop, said fabric member including a free flowing fabric portion extending on either side of said central portion.

* * * * *